US005212878A

United States Patent [19]

Burke et al.

[11] Patent Number: 5,212,878

[45] Date of Patent: May 25, 1993

[54] SOLE WITH REMOVABLE INSERT

[75] Inventors: Robert Burke, Toronto; James Russell, Scarbourgh, both of Canada

[73] Assignee: Bata Limited, Don Mills, Canada

[21] Appl. No.: 828,607

[22] Filed: Jan. 31, 1992

[30] Foreign Application Priority Data

Jul. 19, 1991 [CA] Canada ..... 2047433

[51] Int. Cl.[5] ..... A43B 13/28; A43B 13/37; A43B 13/18

[52] U.S. Cl. ..... 36/27; 36/28; 36/31; 36/114; 36/37; 36/103; 36/35 R

[58] Field of Search ..... 36/27, 25 R, 28, 31, 36/114, 102, 103, 38, 34 R, 35 R, 37

[56] References Cited

U.S. PATENT DOCUMENTS

| | | | |
|---|---|---|---|
| 4,342,158 | 8/1982 | McMahon et al. | 36/35 R |
| 4,573,279 | 3/1986 | Feurer-Zogel et al. | 36/35 R |
| 4,598,487 | 7/1986 | Misevich | 36/114 |
| 4,624,061 | 11/1986 | Wezel et al. | 36/114 |
| 4,680,875 | 7/1987 | Danieli | 36/25 R |
| 4,918,841 | 4/1990 | Turner et al. | 36/114 |
| 5,086,574 | 2/1992 | Bacchiocchi | 36/35 R |

FOREIGN PATENT DOCUMENTS

| | | | |
|---|---|---|---|
| 2951572 | 7/1981 | Fed. Rep. of Germany | 36/114 |
| 3629340 | 3/1988 | Fed. Rep. of Germany | 36/114 |
| 2448308 | 10/1980 | France | 36/35 R |

*Primary Examiner*—Steven N. Meyers
*Assistant Examiner*—Marie D. Patterson
*Attorney, Agent, or Firm*—Eckert Seamans Cherin & Mellott

[57] ABSTRACT

A sole for an article of footwear, such as an athletic shoe, comprises a mass of sole-forming material having provided therein a block of material functioning harmoniously with the remaining mass of material and providing a receptacle in the sole; and a user-selectable, removable insert fitted in the receptacle to impart desired energy characteristics to the sole. The insert can be selected by the user according to his particular needs.

4 Claims, 2 Drawing Sheets

SOLE WITH REMOVABLE INSERT

This invention relates to footwear, and more particularly to a sole for an article of footwear. The invention has applicability to a wide range of footwear, including but not limited to athletic shoes.

Prior art systems are known for tailoring the energy characteristics of shoe soles to particular needs. Such systems include spring inserts within a sole cavity that deflect forces and store energy. The problem with prior art systems is that they are integral within the shoe sole and do not allow the energy characteristics of the shoe to be changed by the user. Clearly different users have different needs according to height, build and degree of athletic ability.

An object of the invention is to provide a sole for an article of footwear having greater versatility than the soles offered by prior art systems.

According to the present invention there is provided a sole for an article of footwear, comprising a mass of soleforming material having provided therein a block of material functioning harmoniously with the remaining mass of material and providing a receptacle in said sole; and a user-selectable, removable insert fitted in said receptacle to impart desired energy characteristics to the sole.

Preferably the receptacle has all round transparency or translucency so that the insert is visible from the planar, lateral, and medial aspects.

By changing the inserts, the force deflecting and energy storing properties of the sole can be changed to meet the needs of the particular user. The insert may include compression springs for energy storage, and there may be more than one insert, such as two fitted into side by side cavities.

The receptacle is preferably open at one end to receive the insert, with locking screws being provided to lock the insert in place in the receptacle.

The receptacle must function harmoniously with the remaining mass of the sole, by which is meant that the receptacle must not significantly disturb the overall resilient properties of the sole. The receptacle should display abrasion resistance characteristics similar to that of the remaining wearing layer. Transparent or translucent polyurethane or materials displaying equivalent properties are preferred.

The inserts can be designed in a number of geometric configurations capable of deflection. They should be made of a suitable material that allows for memory of, and return to, a pre-unstressed shape. Suitable plastic materials are Delrin, Hytrel, PVC and various composites.

The invention will now be described in more detail, by way of example only, with reference to the accompanying drawings, in which.

Figure 1:
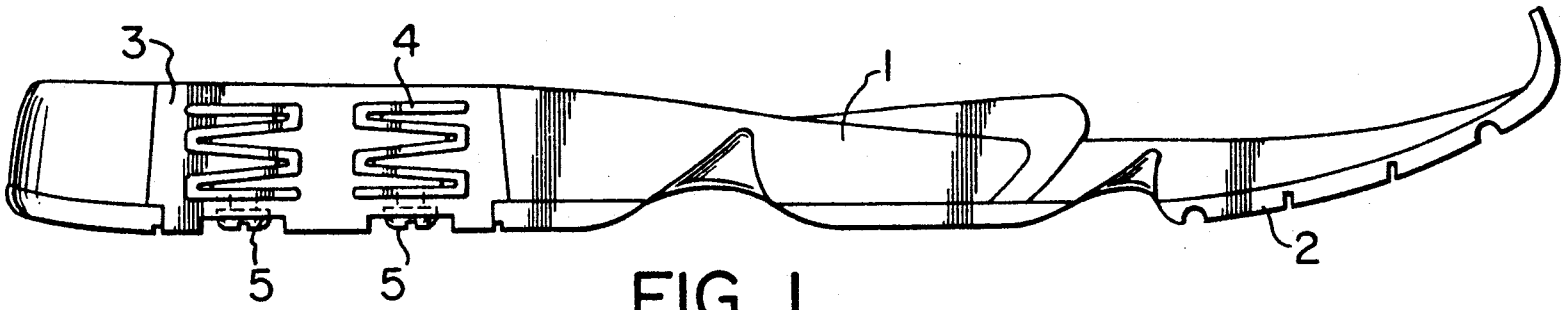
FIG. 1 is a side view of a sole in accordance with the invention.

Referring now to FIG. 1, the sole comprises a resilient mass of material 1 conforming to the shape of the lower part of a shoe. The material of the sole can be any conventional resilient material for making shoe soles, especially athletic shoe soles, although the applicability of the invention is not limited to athletic shoes.

Figure 2:
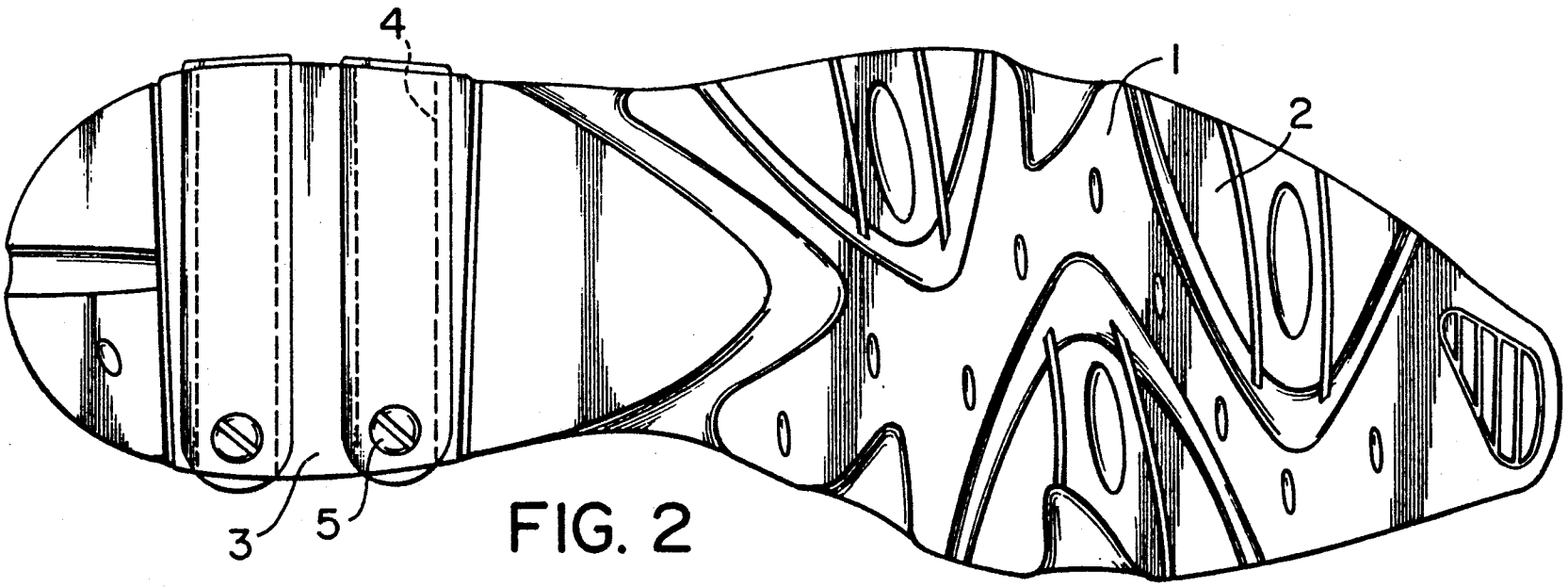
FIG. 2 is a an underneath view of a sole according to the invention.

The under surface of the sole has a conventional pattern 2, as more fully seen in FIG. 2, of grooves and raised portions in the surface thereof.

Figure 3:
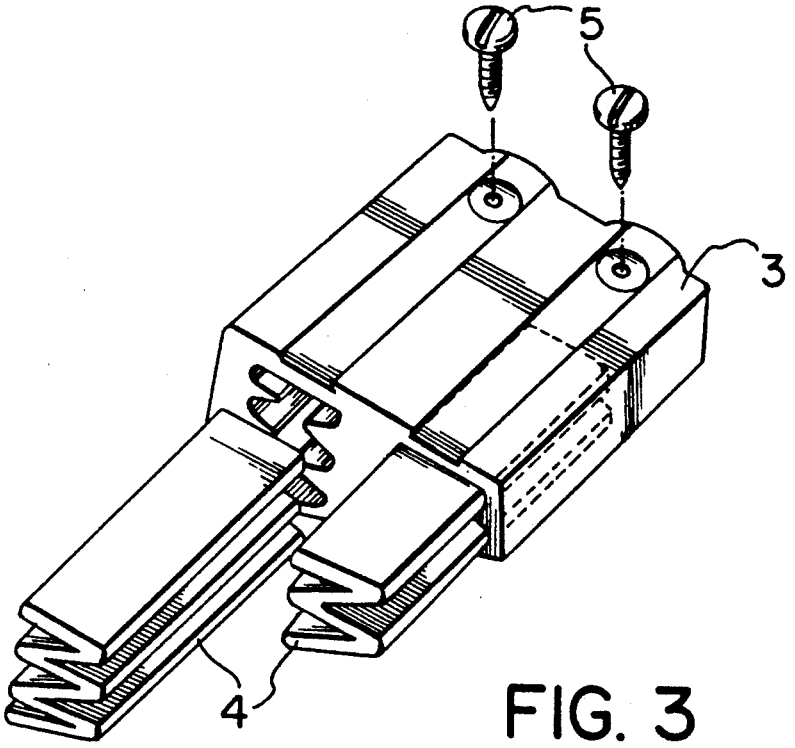
FIG. 3 is a perspective view of a receptacle with a pair of partly inserted inserts.

Moulded into the heel portion of the shoe is a transparent polyurethane receptacle 3 of roughly rectangular configuration and slightly wedge-shaped, as shown in FIG. 3. The receptacle 3 extends across the full width and depth of the sole and forms an integral part thereof. It is molded integrally with the remaining part of the sole or attached to it by suitable adhesive. The resilient properties of the material of the receptacle 3 are chosen such that it functions harmoniously with the remaining mass of material forming the major part of the sole 1.

The receptacle 3 has formed therein a pair of laterally extending, zigzag cavities 4, into which can be slid complementary shaped blocks 4' of DuPont Delrin II 500 material. This material is capable of deflection and has the ability to memorize and return to a pre-unstressed shape. The Delrin II blocks act as a compression spring that absorbs energy on the downward stroke and subsequently returns it to the wearer. The blocks 4' can be seen more clearly in FIG. 3, where they are shown partly inserted into the cavities 4.

In order to retain the resilient blocks 4 in place, locking screws 5 are screwed through the wall of the receptacle 3 into the blocks 4.

The receptacle 3 is made of completely transparent material, which ensures that the blocks 4' are visible from all aspects, including the lateral, mid-sole and plantar aspects.

The blocks 4' can be designed with different characteristics. The user can select a block insert appropriate to his needs and quickly and conveniently insert it into the complementary cavity in the receptacle 3.

The described arrangement thus provides a sole that is conveniently adaptable to the individual wearer's needs. The basic sole can be manufactured in quantity along with inserts having different characteristics that can be selected by the wearer.

The embodiments of the invention in which an exclusive property or privilege is claimed are defined as follows:

1. A sole for an article of footwear, comprising a mass of sole-forming material having provided therein a block of material functioning harmoniously with the remaining mass of soleforming material, said block having a pair of elongate side-by-side zig-zag shaped cavities extending transversely therethrough and having an open end, and a pair of user-selectable, removable elongate inserts having a zig-zag shape in end view complementary to the shape of said cavities and fitted snugly in said respective cavities, said inserts being slidable into and out of said cavities through said open end thereof, said inserts being made of a resilient plastics material having the ability to return to substantially to its pre-stressed condition after deflection, whereby said inserts for part of a compression spring system absorbing energy from a wearer on a downward stroke and subsequently returning such energy to the wearer.

2. A sole as claimed in claim 1, wherein the receptacle is made of transparent material.

3. A sole as claimed in any one of claims 1 to 2, further comprising locking means for locking the removable insert in the receptacle.

4. A sole as claimed in claim 3, wherein the locking means comprise locking screws, screwable through the wall of the receptacle into the insert.

* * * * *